US009387703B2

(12) United States Patent
Mizutani

(10) Patent No.: US 9,387,703 B2
(45) Date of Patent: Jul. 12, 2016

(54) IMAGE RECORDING APPARATUS, CALIBRATION METHOD, AND IMAGE RECORDING METHOD

(71) Applicant: SEIKO EPSON CORPORATION, Tokyo (JP)

(72) Inventor: Seigo Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/641,622

(22) Filed: Mar. 9, 2015

(65) Prior Publication Data

US 2015/0269457 A1 Sep. 24, 2015

(30) Foreign Application Priority Data

Mar. 18, 2014 (JP) ..... 2014-054352

(51) Int. Cl.
*B41J 11/00* (2006.01)
*B41J 2/125* (2006.01)
*B41J 29/38* (2006.01)

(52) U.S. Cl.
CPC ..... *B41J 11/0095* (2013.01); *B41J 2/125* (2013.01); *B41J 29/38* (2013.01)

(58) Field of Classification Search
None
See application file for complete search history.

(56) References Cited

U.S. PATENT DOCUMENTS

2007/0273083 A1* 11/2007 Imai ..... B65H 1/14 271/152
2009/0056412 A1* 3/2009 Graeffe ..... D21G 9/0009 73/1.81
2012/0050373 A1 3/2012 Korogi et al.
2013/0265362 A1 10/2013 Toya
2013/0278665 A1 10/2013 Imamura

FOREIGN PATENT DOCUMENTS

JP 2006-088612 A 4/2006
JP 2010-076872 A 4/2010
JP 2010-111474 A 5/2010
JP 2012-051178 A 3/2012
JP 2013-119167 A 6/2013
JP 2013-215983 A 10/2013
JP 2013-220645 A 10/2013

* cited by examiner

*Primary Examiner* — Fan Zhang
(74) *Attorney, Agent, or Firm* — Global IP Counselors, LLP

(57) ABSTRACT

An image recording apparatus includes: a sensor configured to detect a state of an object and outputs a detection value; a drive unit configured to be able to move the sensor in a direction in which the sensor approaches the object and in a direction in which the sensor is away from the object; and a control unit configured to execute calibration for setting a positional relationship between the sensor and the object based on the detection value of the sensor while causing the drive unit to change the positional relationship between the sensor and the object.

16 Claims, 6 Drawing Sheets

IMAGE RECORDING APPARATUS, CALIBRATION METHOD, AND IMAGE RECORDING METHOD

BACKGROUND

1. Technical Field

The present invention relates to an image recording apparatus and an image recording method for recording an image on a recording medium, and particularly to a technique of detecting states of objects such as a recording medium and a support member for supporting the recording medium.

2. Related Art

In the related art, a printer which records an image on a recording medium by causing a head facing the recording medium to eject ink while transporting the recording medium is known. According to such a printer, a sensor capable of detecting a state in the apparatus is generally used for controlling execution of image recording in accordance with the state in the apparatus. For example, a printer disclosed in JP-A-2013-215983 is provided with a sensor which detects paper jam or foreign matters such as dust that is present on the recording medium.

Incidentally, there is a concern in that detection accuracy of the sensor deteriorates if a positional relationship between an object and the sensor is inappropriate in the image recording apparatus (printer) as described above.

SUMMARY

An advantage of some aspects of the invention is to provide a technique of suppressing deterioration of the detection accuracy of the sensor by appropriately determining the positional relationship between the sensor and the object.

According to an aspect of the invention, there is provided an image recording apparatus including: a sensor configured to detect a state of an object and outputs a detection value; a drive unit configured to be able to move the sensor in a direction in which the sensor approaches the object and in a direction in which the sensor is away from the object; and a control unit configured to execute calibration for setting a positional relationship between the sensor and the object based on the detection value of the sensor while causing the drive unit to change the positional relationship between the sensor and the object.

According to another aspect of the invention, there is provided a calibration method including: setting a positional relationship between an object and a sensor capable of detecting a state of the object based on a detection value of the sensor while changing the positional relationship between the sensor and the object by moving the sensor.

According to still another aspect of the invention, there is provided an image recording method including: a first process in which a positional relationship between an object and a sensor capable of detecting a state of the object is set based on a detection value of the sensor while changing the positional relationship between the sensor and the object by moving the sensor; and a second process in which an image recording is executed.

According to the invention (the image recording apparatus, the calibration method, and the image recording method) configured as described above, the positional relationship between the sensor and the object is set based on the detection value of the sensor while changing the positional relationship between the sensor and the object. As a result, it is possible to appropriately set the positional relationship between the sensor and the object and to suppress deterioration of detection accuracy of the sensor.

In this case, the calibration may include position adjustment processing of adjusting the positional relationship between the sensor and the object based on the detection value of the sensor while causing the drive unit to change the positional relationship between the sensor and the object and processing of determining whether or not the position adjustment processing has successfully been performed.

In this case, the object may be a recording medium on which an image is recorded.

In this case, the control unit may execute the calibration when a type of the recording medium is changed. With such a configuration, it is possible to appropriately set the positional relationship between the sensor and the recording medium and to suppress deterioration of the detection accuracy of the sensor even of the position relationship between the sensor and the recording medium changes with the change of the type of the recording medium as an object.

In such a case, the control unit may execute the calibration when the recording medium is replaced. With such a configuration, it is possible to appropriately set the positional relationship between the sensor and the recording medium and to suppress deterioration of the detection accuracy of the sensor even of the positional relationship between the sensor and the recording medium changes as the replacement of the recording medium as the object.

Incidentally, positional adjustment processing is not always successfully performed in the calibration. For example, there is a case in which a position of the object to be detected by the sensor is not suitable for the position adjustment processing due to an influence of a foreign matter or the like which is present on the object. In such a case, the positional relationship between the sensor and the object, which is adjusted in the position adjustment processing, is not always appropriate.

Thus, in the processing of determining whether or not the position adjustment processing has successfully been made, the control unit may determine whether or not the position adjustment processing has successfully been performed based on comparison of a positional relationship between the sensor and the object, which is expected based on a thickness of the recording medium, with a positional relationship between the sensor and the object after the position adjustment processing. That is, the appropriate positional relationship between the sensor and the recording medium can be expected to some extent based on the thickness of the recording medium. Therefore, according to this configuration, it is determined whether or not the position adjustment processing has successfully been performed based on the comparison of the positional relationship between the sensor and the object, which is expected based on the thickness of the recording medium, with the positional relationship between the sensor and the object after the position adjustment processing. In doing so, it is possible to grasp whether or not the position adjustment processing has successfully been performed.

In this case, in the processing of determining whether or not the position adjustment processing has successfully been made, the control unit may execute the position adjustment processing again if it is determined that the position adjustment processing has failed. With such a configuration, it is possible to appropriately set the positional relationship between the sensor and the recording medium and to suppress deterioration of the detection accuracy of the sensor by executing the position adjustment processing again even if the position adjustment processing fails.

In this case, the image recording apparatus may include a support member configured to support a recording medium, on which an image is recorded, and thermally expand with an increase in temperature, and the object may be the support member.

In this case, the image recording apparatus may be include an acquisition unit configured to acquire a value relating to the thermal expansion of the support member, and the control unit may execute the calibration based on the value obtained by the acquisition unit. With such a configuration, it is possible to appropriately set the positional relationship between the sensor and the support member and to suppress deterioration of the detection accuracy of the sensor even of the support member as the object thermally expands or thermally contracts with variations in temperature.

As described above, there is a case in which the position adjustment processing fails in the calibration since the position of the object to be detected by the sensor is not suitable for the position adjustment processing. Therefore, in the processing of determining whether or not the position adjustment processing has successfully been made, the control unit may determine whether or not the position adjustment processing has successfully been made based on a result obtained by causing the sensor to detect a first position as a position of the object which is detected by the sensor in the position adjustment processing and a second position as a position of the object which is different from the first position in a transport direction of the object.

In this case, in the processing of determining whether or not the position adjustment processing has successfully been made, the control unit may execute the position adjustment processing again if it is determined that the position adjustment processing has failed. With such a configuration, it is possible to appropriately set the positional relationship between the sensor and the object and to suppress deterioration of the detection accuracy of the sensor by executing the position adjustment processing again even if the position adjustment processing fails.

In this case, in the processing of determining whether or not the position adjustment processing has successfully been made, the control unit may execute the position adjustment processing at each of three or more positions of the object, which are different from each other in the transport direction, and set the positional relationship between the sensor and the object based on a result of the position adjustment processing other than position adjustment processing, in which a value representing the positional relationship between the sensor and the object is an outlier, from among the position adjustment processing performed the plurality of times. With such a configuration, it is possible to set the positional relationship based on the result of adjusting the positional relationship between the sensor and the object at a position suitable for the position adjustment processing from among a plurality of different positions in the transport direction. As a result, it is possible to appropriately set the positional relationship between the sensor and the object and to suppress deterioration of the detection accuracy of the sensor.

In this case, in the position adjustment processing, the positional relationship between the sensor and the object may be adjusted such that the detection value of the sensor is within a predetermined range.

In this case, the sensor may be a foreign matter sensor configured to detect a foreign matter on the object on one side of the object, and the control unit may set the positional relationship between the sensor and the object such that the sensor is made to deviate on the one side with respect to the object as compared with the positional relationship adjusted in the position adjustment processing, after execution of the position adjustment processing. With such a configuration, it is possible to obtain a positional relationship between the sensor and the object which is suitable for foreign matter detection and to precisely detect a foreign matter.

In this case, the sensor may include a light emitting unit provided so as to correspond to one end of the object and a light receiving unit provide so as to correspond to the other end of the object, and the sensor may output a detection value in accordance with an amount of light emitted by the light emitting unit and received by the light receiving unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
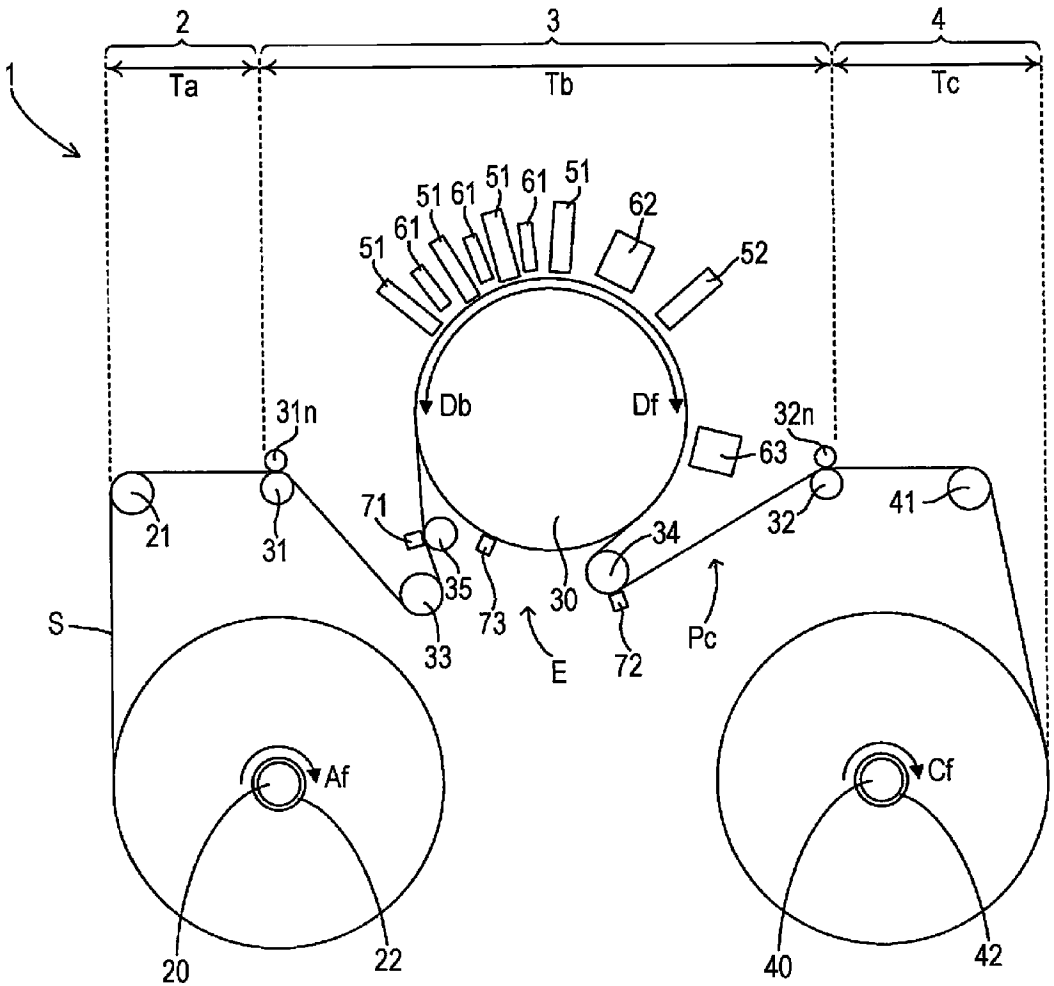
FIG. 1 is a front view showing an example of an apparatus configuration of a printer which can implement the invention.

FIG. 1 is a front view schematically showing an example of an apparatus configuration included in a printer which can implement the invention. According to a printer 1, a sheet S (web), both end of which are wound around a delivery shaft 20 and a winding shaft 40 in roll shapes, is stretched along a transport path Pc, and the sheet S is subjected to image recording while being transported in a transport direction Df from the delivery shaft 20 toward the winding shaft 40 as shown in FIG. 1. Types of a base material of the sheet S are roughly classified into a paper type base material and a film type base material. Specific examples of the paper type base material include a high-quality paper, a cast-coated paper, an art paper, and a coated paper. Specific examples of the film-type base material include a polyethylene terephthalate (PET) film and a polypropylene (PP) film. Roughly, the printer 1 is provided with a delivery unit 2 (delivery region) configured to deliver the sheet S from the delivery shaft 20, a process unit 3 (process region) configured to record an image on the sheet S which is delivered by the delivery unit 2, and a winding unit 4 (winding region) configured to wind the sheet S, on which the image has been recorded by the process unit 3, around the winding shaft 40. In the following description, a surface, on which the image is recorded, in both surfaces of the sheet S will be referred to as a front surface, and another surface opposite to the surface will be referred to as a back surface.

The delivery unit 2 is provided with the delivery shaft 20 around which an end of the sheet S is wound and a driven roller 21 around which the sheet S drawn out of the delivery shaft 20 is wound. The end of the sheet S is wound around and supported by the delivery shaft 20 in a state in which the front surface of the sheet S faces outside. By rotating the delivery shaft 20 in a rotation direction Af (a clockwise direction in FIG. 1), the sheet S wound around the delivery shaft 20 is delivered to the process unit 3 via the driven roller 21. In addition, the sheet S is wound around the delivery shaft 20 via a core tube 22 which can be attached to and detached from the delivery shaft 20. Therefore, if the sheet S wound around the delivery shaft 20 is used up, the sheet S wound around the delivery shaft 20 can be replaced by attaching a new core tube 22 around which the sheet S is wound in a roll shape to the delivery shaft 20.

The process unit 3 supports the sheet S, which is delivered by the delivery unit 2, at a rotation drum 30 and to appropriately causes the respective functional units 51, 52, 61, 62, and 63 arranged along an outer circumferential surface of the rotation drum 30 to perform processing to record an image on the sheet S. In the process unit 3, a front drive roller 31 and a back drive roller 32 are provided on both sides of the rotation drum 30, and the sheet S transported in the transport direction Df from the front drive roller 31 to the back drive roller 32 is supported at the rotation drum 30 and is subjected to image recording.

The front drive roller 31 includes a plurality of minute projections which are formed by thermal spraying on the outer circumferential surface thereof, and the sheet S delivered by the delivery unit 2 is wound around the front drive roller 31 from the back surface side. By rotating the front drive roller 31 in the clockwise direction in FIG. 1, the sheet S delivered by the delivery unit 2 is transported to a downstream side in the transport direction Df. In addition, the front drive roller 31 is provided with a nipping roller 31*n* (driven roller). The nipping roller 31*n* abuts on the surface of the sheet S in a state of being biased to the side of the front drive roller 31 and pinches the sheet S with the front drive roller 31. In so doing, it is possible to secure frictional force between the front drive roller 31 and the sheet S and thereby to reliably transport the sheet S by the front drive roller 31.

The rotation drum 30 is a cylindrical drum which is supported so as to be rotatable in both the transport direction Df and the opposite direction Db by a support mechanism which is not shown in the drawing. The rotation drum 30 is configured of metal (aluminum) and has a diameter of 690 mm. A radius of the rotation drum 30 changes by 0.00818 mm if a temperature changes by 1° C. The sheet S transported from the front drive roller 31 to the back drive roller 32 is wound around the rotation drum 30 from the back surface side, the rotation drum 30 is rotated along with the sheet S due to the frictional force between the rotation drum 30 and the sheet A and supports the sheet S from the back surface side. In addition, the process unit 3 is provided with driven rollers 33 and 34 configured to fold back the sheet S on both sides of the rotation drum 30, on which the sheet S is folded back to be wound around the rotation drum 30. The driven roller 33 folds back the sheet S by winding the surface of the sheet S between the front drive roller 31 and the rotation drum 30. In contrast, the driven roller 34 folds back the sheet S by winding the surface of the sheet S between the rotation drum 30 and the back drive roller 32. By folding back the sheet S on both the upstream side and the downstream side of the rotation drum 30 in the transport direction Df as described above, it is possible to secure a long length for a portion of the rotation drum 30 around which the sheet S is wound.

The back drive roller 32 includes a plurality of minute projections formed by thermal spraying on the outer circumferential surface thereof, and the sheet S transported from the rotation drum 30 via the driven roller 34 is wound around the back drive roller 32 from the back surface side. By rotating the back drive roller 32 in the clockwise direction in FIG. 1, the sheet S is transported to the winding unit 4 on the downstream side in the transport direction Df. In addition, the back drive roller 32 is provided with a nipping roller 32*n* (driven roller). The nipping roller 32*n* abuts on the surface of the sheet S in a state of being biased to the side of the back drive roller 32 and pinches the sheet S with the back drive roller 32. In doing so, it is possible to secure frictional force between the back drive roller 32 and the sheet S and to reliably transport the sheet S by the back drive roller 32.

As described above, the sheet S transported from the front drive roller 31 to the back drive roller 32 is supported at the outer circumferential surface of the rotation drum 30. In addition, the process unit 3 is provided with a plurality of recording heads 51 corresponding to different colors in order to record a color image on the surface of the sheet S supported at the rotation drum 30. Specifically, four recording heads 51 corresponding to yellow, cyan, magenta, and black are aligned in this order in the transport direction Df. Each recording head 51 faces the surface of the sheet S, which is wound around the rotation drum 30, with a small clearance and ejects ink (color ink) of a corresponding color from nozzles. By causing the respective recording heads 51 to eject the ink onto the sheet S which is transported in the transport direction Df, the color image is formed on the surface of the sheet S.

As the ink, ultraviolet (UV) ink (photocurable ink) which is cured by irradiation with ultraviolet light (light) is used. Thus, the process unit 3 is provided with UV irradiators 61 and 62 (irradiation units) in order to cure and fix the ink on the sheet S. The curing of the ink is executed in two stages, namely temporary curing and final curing. Between the plurality of recording heads 51, a UV irradiator 61 for temporary curing is arranged. That is, the ink is cured (temporarily cured) to some extent, to which an ink spreading speed becomes sufficiently low as compared with a case in which the ink is not irradiated with ultraviolet light, by the UV irradiator 61 irradiating the ink with the ultraviolet light of low irradiation intensity, and the ink is not completely cured. In contrast, the UV irradiator 62 for final curing is provided on the downstream side of the plurality of recording heads 51 in the transport direction Df. That is, the UV irradiator 62 is for curing (finally curing) the ink to an extent, to which spreading of the ink is stopped, by irradiating the ink with the ultraviolet light of higher irradiation intensity than that of the UV irradiator 61.

As described above, the UV irradiator 61 arranged between the plurality of recording heads 51 temporarily cure the color ink which is ejected from the recording heads 51 on the upstream side in the transport direction Df onto the sheet S. Therefore, the ink ejected by a certain recording head 51 is temporarily cured until the ink reaches another recording head 51 that is adjacent to the certain recording head 51 on the downstream side in the transport direction Df. In so doing, mixing of different color ink is suppressed. The plurality of recording heads 51 eject different color ink and form a color image on the sheet S in the state in which the mixing of colors is suppressed. Furthermore, the UV irradiator 62 for final curing is provided on the downstream side of the plurality of recording heads 51 in the transport direction Df. For this reason, the color image formed by the plurality of recording heads 51 is finally cured and fixed on the sheet S by the UV irradiator 62.

Furthermore, a recording head 52 is provided on the downstream side of the UV irradiator 62 in the transport direction Df. The recording head 52 faces the surface of the sheet, which is wound around the rotation drum 30, with a small clearance and ejects transparent UV ink from nozzles by an ink jet scheme. That is, the transparent ink is further ejected onto the color image which is formed by the recording heads 51 for the four colors. The transparent ink is ejected to the entire surface of the color image and provides a glossy appearance or a matt appearance to the color image. In addition, the UV irradiator 63 (irradiation unit) is provided on the downstream side of the recording head 52 in the transport direction Df. By the UV irradiator 63 irradiating the transparent ink with intense ultraviolet light, the transparent ink ejected by the recording head 52 is finally cured. In so doing, the transparent ink can be fixed to the surface of the sheet S.

As described above, the process unit 3 appropriately ejects the ink onto the sheet S, which is wound around the outer circumferential portion of the rotation drum 30, cures the ink, and form the color image coated with the transparent ink. Then, the sheet S with the color image formed thereon is transported to the winding unit 4 by the back drive roller 32.

The winding unit 4 includes a driven roller 41 around which the sheet S is wound form the back surface side between the winding shaft 40 and the back drive roller 32, in addition to the winding shaft 40 around which the end of the sheet S is wound. The winding shaft 40 winds and supports the end of the sheet S in a state in which the front surface of the sheet S faces the outside. That is, if the winding shaft 40 is rotated in the rotation direction Cf (clockwise direction in FIG. 1), the sheet S transported by the back drive roller 32 is then wound around the winding shaft 40 via the driven roller 41. In addition, the sheet S is wound around the winding shaft 40 via a core tube 42 which can be attached to and detached from the winding shaft 40. Therefore, if the winding shaft 40 becomes full with the sheet S wound around the winding shaft 40, it is possible to detach the sheet S along with the core tube 42.

In addition, the printer 1 according to the embodiment is provided with foreign matter sensors 71 and 72 configured to detect presence of a foreign matter on the sheet S and a foreign matter sensor 73 configured to detect presence of a foreign matter on the rotation drum 30. Here, the foreign matter on the sheet S includes at least one of a wrinkle, a folded part, a torn part, a frayed part, and a fluffing part of the sheet S, an adhesive which adheres to the sheet S and configures a part of the sheet S, dust which adheres to the sheet S, ink which does not configure an image and adheres to and is solidified on the sheet S. The foreign matter on the rotation drum 30 includes at least one of ink which adheres to and is solidified on the outer circumferential surface of the rotation drum 30 and does not configure an image, an adhesive which configures a part of the sheet S, and dust.

The foreign matter sensor 71 is arranged between the driven roller 33 and the rotation drum 30 and detects the state of the surface of the sheet S on the upstream side of the recording heads 51 and 52 in the transport direction Df. That is, the foreign matter sensor 71 detects presence of a foreign matter on the sheet S before an image is recorded by the recording heads 51 and 52, on the front surface side of the sheet S. In addition, a detection region of the foreign matter sensor 71 is backed up by a backup roller 35 around which the sheet S is wound from the back surface side, and flapping of the sheet S in the detection region of the foreign matter sensor 71 is suppressed.

The foreign matter sensor 72 detects the state of the back surface of the sheet S on the downstream side of the recording heads 51 and 52 in the transport direction Df. That is, the foreign matter sensor 72 detects presence of a foreign matter on the sheet S after the image is recorded by the recording heads 51 and 52, on the back surface side of the sheet S. Here, the foreign matter sensor 72 performs the detection on the back surface side instead of the front surface side of the sheet S mainly for the following reasons. That is, a wrinkle, a folded part, or a tone part of the sheet S can be detected on the back surface side of the sheet S. Furthermore, there is an advantage in that it is possible to exclude an influence of the image recorded on the surface of the sheet S on detection accuracy of the foreign matter sensor 72 by detecting the presence of the foreign matter on the back surface side of the sheet S. Moreover, the detection region of the foreign matter sensor 72 is backed up by the driven roller 34 around which the sheet S is wound from the front surface side, and flapping of the sheet S in the detection region of the foreign matter sensor 72 can be suppressed.

The foreign matter sensor 73 detects a state of a portion (exposed portion E) of the outer circumferential surface of the rotation drum 30, around which the sheet S is not wound, and which is exposed. That is, the foreign matter sensor 73 detects presence of the foreign matter on the outer circumferential surface of the rotation drum 30 at the exposed portion E.

Figure 2:
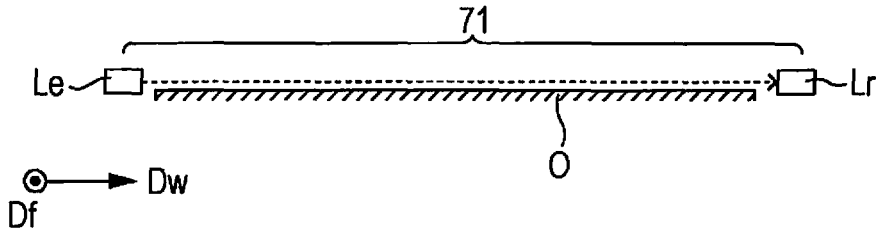
FIG. 2 is a diagram showing an example of a configuration of a foreign matter sensor.

FIG. 2 is a diagram schematically showing an example of a configuration of each foreign matter sensor. Since the foreign matter sensors 71, 72, and 73 have the same configuration, only the foreign matter sensor 71 will be described herein. The foreign matter sensor 71 includes a light emitting unit Le configured to emit light and a light receiving unit r configured to receive light. In a width direction which orthogonally intersects the transport direction Df and is parallel with a surface of an object O (the outer circumferential surface of the sheet S herein), the light emitting unit Le is arranged on one side of the object O, the light receiving unit Lr is arranged on the other side of the object O, and the light emitting unit Le and the light receiving unit Lr face each other in the width direction Dw. Therefore, if there is no foreign matter on the object O between the light emitting unit Le and the light receiving unit Lr, the light emitted by the light emitting unit Le advances along the object O and reaches the light receiving unit Lr, and the light receiving unit Lr outputs a signal of a first level. In contrast, if there is a foreign matter on the object O between the light emitting unit Le and the light receiving unit Lr, at least a part of the light emitted by the light emitting unit Le is blocked by the foreign matter and does not reach the light receiving unit Lr, and the light receiving unit Lr outputs a signal of a second level that is lower than the first level. As described above, the foreign matter sensor 71 outputs signals of different levels from the light receiving unit Lr depending on presence of a foreign matter on the object O.

Figure 3:
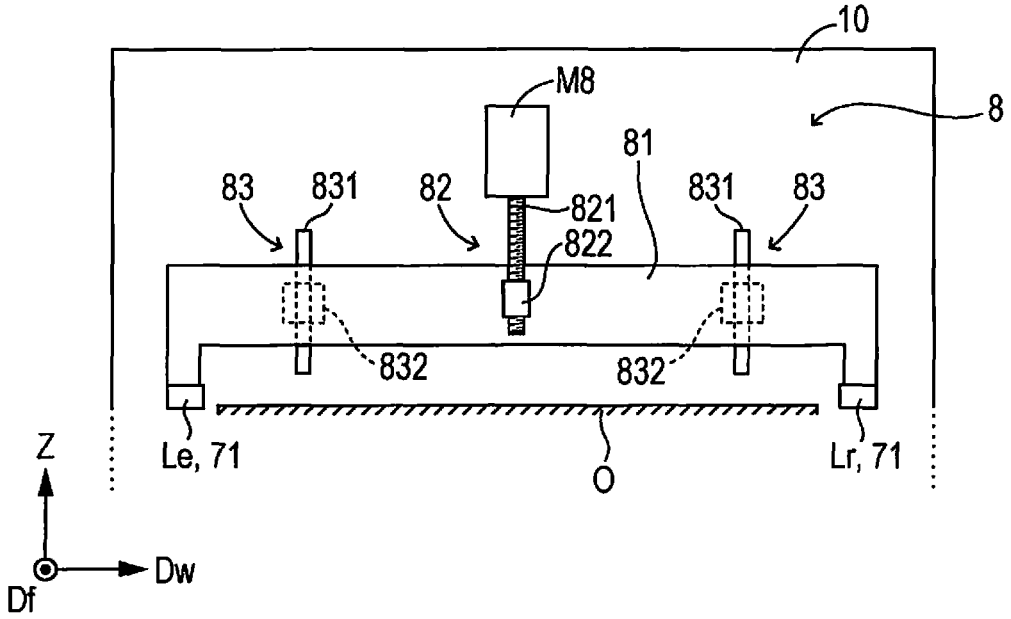
FIG. 3 is a diagram showing an example of a configuration of a drive unit which moves the foreign matter sensor.

The foreign matter sensor 71 from among the foreign matter sensors 71, 72, and 73 can move relative to the object O. Specifically, the printer 1 is provided with a drive unit 8 configured to move the foreign matter sensor 71 (FIG. 3). Here, FIG. 3 is a diagram schematically showing an example of a configuration of the drive unit for moving the foreign matter sensor. As shown in FIG. 3, the drive unit 8 includes a coupling member 81, a ball screw 82, a linear motion (LM) guide 83, and a sensor motor M8.

The coupling member 81 has a shape extending in the width direction Dw, and the light emitting unit Le and the light receiving unit Lr are fixed to both ends of the coupling member 81 in the width direction Dw. In addition, the coupling member 81 is attached to a frame 10 of the printer 1 via the LM guide 83. The LM guide 83 is configured of an LM rail 831 extending in a Z direction (a direction orthogonally intersecting the transport direction Df and the width direction Dw) of approaching and separating from the object O and an LM block 832 which moves along the LM rail 831. The LM rail 831 is attached to the frame 10, and the LM block 832 is attached to the coupling member 81. As described above, the coupling member 81 can move in the Z direction along with the foreign matter sensor 71 (the light emitting unit Le and the light receiving unit Lr).

Such a coupling member 81 is connected to the sensor motor M8, which is fixed to the frame 10, via the ball screw 82. The ball screw 82 is configured of a screw shaft 821 extending in the Z direction and a nut 822 fitted onto the screw shaft 821. The screw shaft 821 is attached to an output shaft of the sensor motor M8, and the nut 822 is attached to the coupling member 81. Therefore, by the sensor motor M8 rotating the screw shaft 821, it is possible to move the coupling member 81 in the Z direction and to move the foreign matter sensor 73 (the light emitting unit Le and the light receiving unit Lr) in the Z direction.

Figure 4:
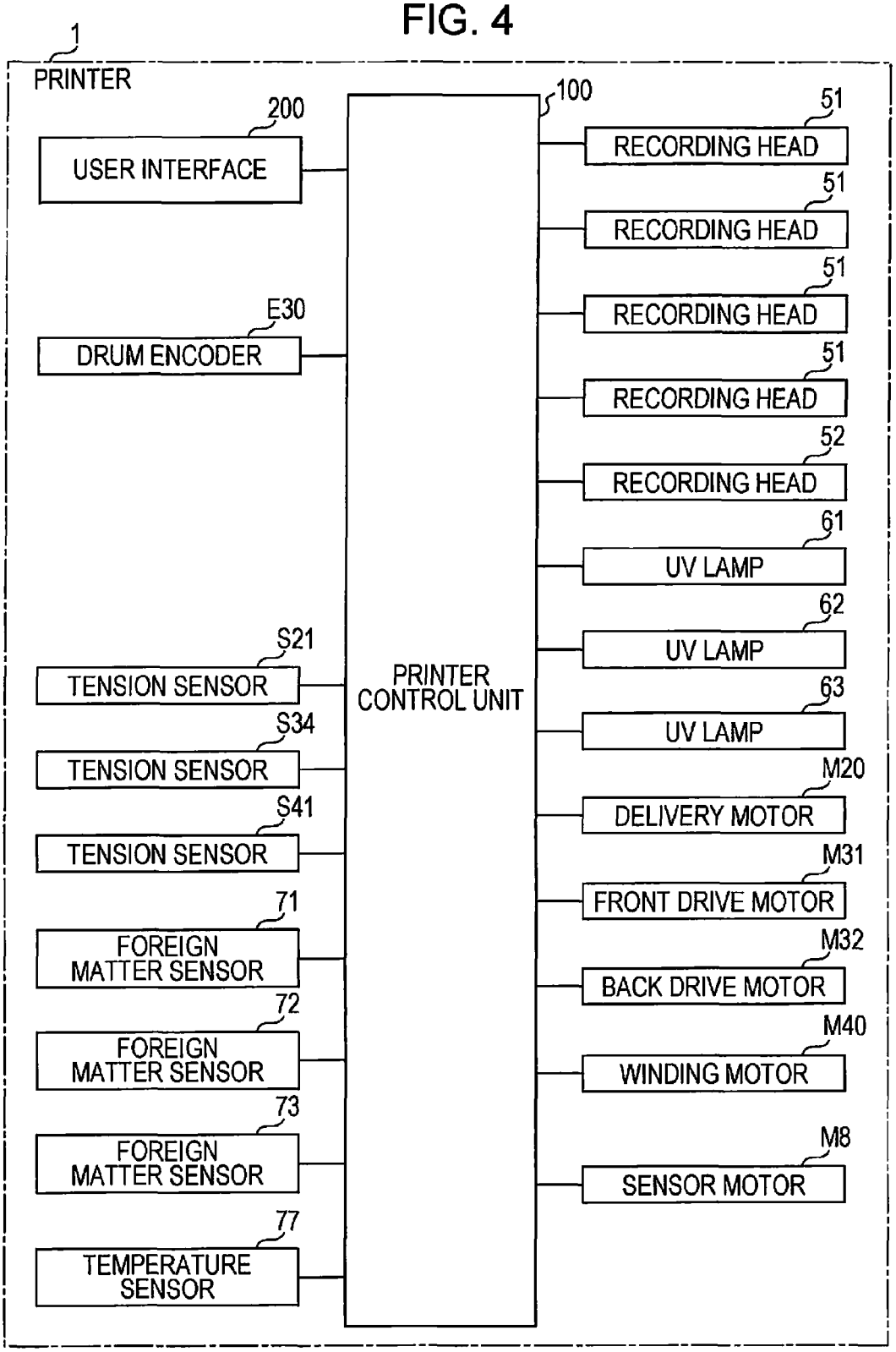
FIG. 4 is a block diagram showing an example of an electric configuration which controls the printer shown in FIG. 1.

The outline of the apparatus configuration of the printer 1 was described hitherto. Next, a description will be given of an electrical configuration for controlling the printer 1. FIG. 4 is a block diagram schematically showing an example of an electrical configuration for controlling the printer shown in FIG. 1. The printer 1 is provided with a printer control unit 100 configured to have a function of controlling the entire apparatus and a user interface 200 configured to have an interface function with a user. The user interface 200 displays an operation state of the printer 1 in response to control by the printer control unit 100 and receives an input from the user. The user interface 200 is configured of a personal computer or a touch panel-type display, for example. In addition, the printer control unit 100 controls the respective components of the apparatus, such as the recording heads, the UV irradiators, and the sheet transport system, based on a command or information input by the user via the user interface 200. Details of the control performed by the printer control unit 100 on the respective components in the apparatus are as follows.

The printer control unit 100 controls an ink ejection timing of each recording head 51 for forming a color image in accordance with transport of the sheet S. Specifically, the ink ejection timing is controlled based on an output (detection value) of a drum encoder E30 which is attached to the rotation shaft of the rotation drum 30 and detects a rotation position of the rotation drum 30. That is, since the rotation drum 30 is rotated along with the transport of the sheet S, it is possible to grasp the transport position of the sheet S with reference to the output of the drum encoder E30 which detects the rotation position of the rotation drum 30. Thus, the printer control unit 100 forms a color image by generating a print timing signal (pts) based on the output of the drum encoder E30, controlling the ink ejection timing of each recording head 51 based on the pts signal, and causing the ink ejected by each recording head 51 to land on a targeted position on the transported sheet S.

In addition, a timing at which the recording head 52 ejects the transparent ink is also controlled by the printer control unit 100 based on the output of the drum encoder E30 in the same manner. In so doing, it is possible to precisely eject the transparent ink onto the color image which is formed by the plurality of recording heads 51. Furthermore, a timing at which the UV irradiators 61, 62, and 63 are turned on or off and irradiation light intensities thereof are also controlled by the printer control unit 100.

In addition, the printer control unit 100 has a function of controlling the transport of the sheet S, which was described above in detail with reference to FIG. 1. That is, motors are connected to the delivery shaft 20, the front drive roller 31, the back drive roller 32, and the winding shaft 40 from among the members which configure the sheet transport system. In addition, the printer control unit 100 controls the transport of the sheet S by controlling speeds and torques of the respective motors while rotating these motors. A detailed description of the control of the transport of the sheet S will be given below.

The printer control unit 100 rotates a delivery motor M20 for driving the delivery shaft 20 and supplies the sheet S from the delivery shaft 20 to the front drive roller 31. At this time, the printer control unit 100 adjusts tension (delivery tension Ta) of the sheet S from the delivery shaft 20 to the front drive roller 31 by controlling a torque of the delivery motor M20. That is, a tension sensor S21 for detecting a magnitude of the delivery tension Ta is attached to the driven roller 21 arranged between the delivery shaft 20 and the front drive roller 31. The tension sensor S21 can be configured of a load cell which detects a magnitude of force applied from the sheet S, for example. Then, the printer control unit 100 feed-back controls the torque of the delivery motor M20 based on the detection result (detection value) of the tension sensor S21 and adjusts the delivery tension Ta of the sheet S.

In addition, the printer control unit 100 rotates a front drive motor M31 for driving the front drive roller 31 and a back drive motor M32 for driving the back drive roller 32. In so doing, the sheet S delivered by the delivery unit 2 is made to pass through the process unit 3. At this time, a speed of the front drive motor M31 is controlled, and a torque of the back drive motor M32 is controlled. That is, the printer control unit 100 adjusts the rotation speed of the front drive motor M31 to a constant speed based on the output of the encoder of the front drive motor M31. As described above, the sheet S is transported at a constant speed by the front drive roller 31.

In contrast, the printer control unit 100 adjusts tension (process tension Tb) of the sheet S from the front drive roller 31 to the back drive roller 32 by controlling a torque of the back drive motor M32. That is, a tension sensor S34 for detecting a magnitude of the process tension Tb is attached to the driven roller 34 arranged between the rotation drum 30 and the back drive roller 32. The tension sensor S34 can be configured of a load cell which detects a magnitude of force applied form the sheet S, for example. Then, the printer control unit 100 feed-back controls the torque of the back drive motor M32 based on the detection result (detection value) of the tension sensor S34 and adjusts the process tension Tb of the sheet S.

In addition, the printer control unit 100 winds the sheet S, which is transported by the back drive roller 32, around the winding shaft 40 by rotating a winding motor M40 for driving the winding shaft 40. At this time, the printer control unit 100 adjusts tension (winding tension Tc) of the sheet S from the back drive roller 32 to the winding shaft 40 by controlling a torque of the winding motor M40. That is, a tension sensor S41 for detecting a magnitude of the winding tension Tc is attached to the driven roller 41 arranged between the back drive roller 32 and the winding shaft 40. The tension sensor S41 can be configured of a load cell which detects a magnitude of force applied from the sheet S, for example. Then, the printer control unit 100 feed-back controls the torque of the winding motor M40 based on the detection result (detection value) of the tension sensor S41 and adjusts the winding tension Tc of the sheet S.

As described above, the printer control unit 100 causes the recording heads 51 and 52 to record an image on the sheet S while transporting the sheet S in the transport direction Df from the delivery shaft 20 toward the winding shaft 40. In addition, the printer control unit 100 can also execute backward transport of transporting the sheet S in the transport direction Db (that is, the direction opposite to the transport direction Df) from the winding shaft 40 toward the delivery shaft 20 as well as forward transport of transporting the sheet S in the transport direction Df. Specifically, the printer control unit 100 executes the backward transport by controlling the respective motors M20, M31, M32, and M40 so as to rotate the delivery shaft 20, the front drive roller 31, the back drive roller 32, and the winding shaft 40 in the direction opposite to the direction in the case of the forward transport. Such backward transport can be executed for various purposes as proposed in JP-A-2013-129062. For example, the backward transport is executed to form a new image so as to be adjacent to an image, which has already been formed on the sheet S, by appropriately returning the sheet S to the side of the delivery shaft 20 when suspended image recording is restarted again.

During execution of the forward transport, the printer control unit 100 monitors detection results of the foreign matter sensors 71 and 73. If the foreign matter sensors 71 and 73 detect a foreign matter, the printer control unit 100 stops the forward transport. That is, if the foreign matter sensor 71 detects a foreign matter on the sheet S, there is a concern in that the foreign matter collides with the recording heads 51 and 52 if the foreign matter is transported in the transport direction Df without being removed. If the foreign matter sensor 73 detects a foreign matter on the rotation drum 30, the foreign matter enters between the sheet S and the rotation drum 30 and lifts the sheet S if the foreign matter is transported in the transport direction Df without being removed. As a result, there is a concern in that the lifted portion of the sheet S collides with the recording heads 51 and 52. Thus, the printer control unit 100 stops the forward transport in order to avoid the collision with the recording heads 51 and 52.

In contrast, the printer control unit 100 monitors detection results of the foreign matter sensors 72 and 73 during execution of the backward transport. If the foreign matter sensors 72 and 73 detect a foreign matter, the printer control unit 100 stops the backward transport. That is, if the foreign matter sensor 72 detects a foreign matter on the sheet S, there is a concern in that the foreign matter collides with the recording heads 51 and 52 if the foreign matter is transported in the transport direction Db without being removed. If the foreign matter sensor 73 detects a foreign matter on the rotation drum 30, the foreign matter enters between the sheet S and the rotation drum 30 and lifts the sheet S if the foreign matter is transported in the transport direction Db without being removed. As a result, there is a concern in that the lifted portion of the sheet S collides with the recording heads 51 and 52. Thus, the printer control unit 100 stops the backward transport in order to avoid the collision with the recording heads 51 and 52.

Incidentally, a positional relationship between the foreign matter sensors 71, 72, and 73 and the object O influences on accuracy of the aforementioned foreign matter sensors 71, 72, and 73 detecting the foreign matter on the object O. This is because a foreign matter is not completely within the optical path of the light emitted from the light emitting unit Le to the light receiving unit Lr and the foreign matter cannot be detected correctly if the foreign matter sensors 71, 72, and 73 are located at excessively far positions from the object O. In addition, a major part of the light emitted from the light emitting unit Le is scattered by the surface of the object O and the foreign matter cannot be detected correctly if the foreign matter sensors 71, 72, and 73 are located at excessively close positions to the object O. For this reason, it is important to appropriately set the positional relationship between the object and at least the foreign matter sensor, which is strictly required to have detection accuracy of a foreign matter, from among the foreign matter sensors 71, 72, and 73. Thus, according to the embodiment, calibration is appropriately performed on the foreign matter sensor 71, in particular, and the positional relationship between the foreign matter sensor 71 and the object O is appropriately set.

Figure 5A:
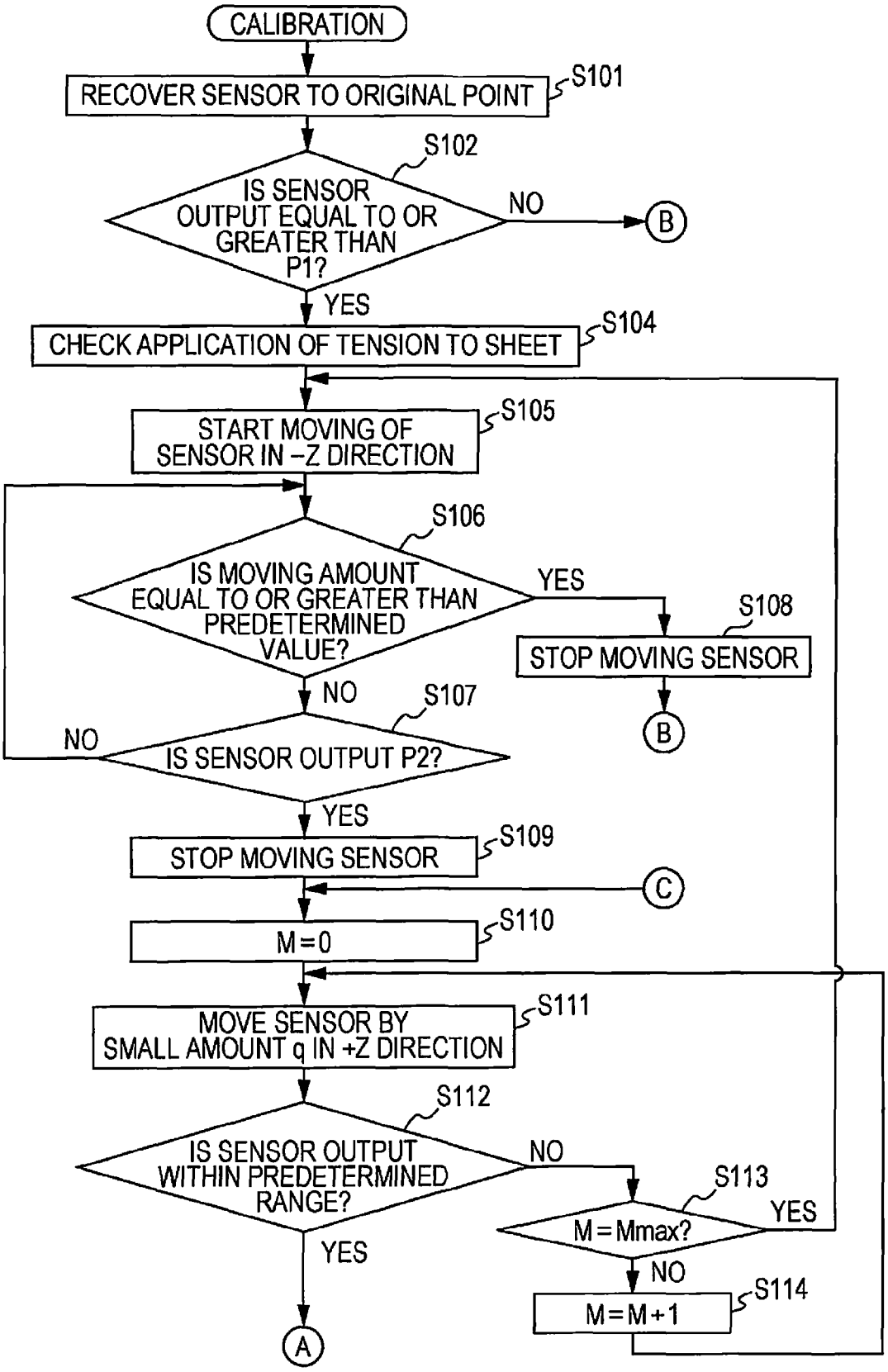
FIGS. 5A and 5B are flowcharts showing an example of calibration which is executed on the foreign matter sensor.
Figure 5B:
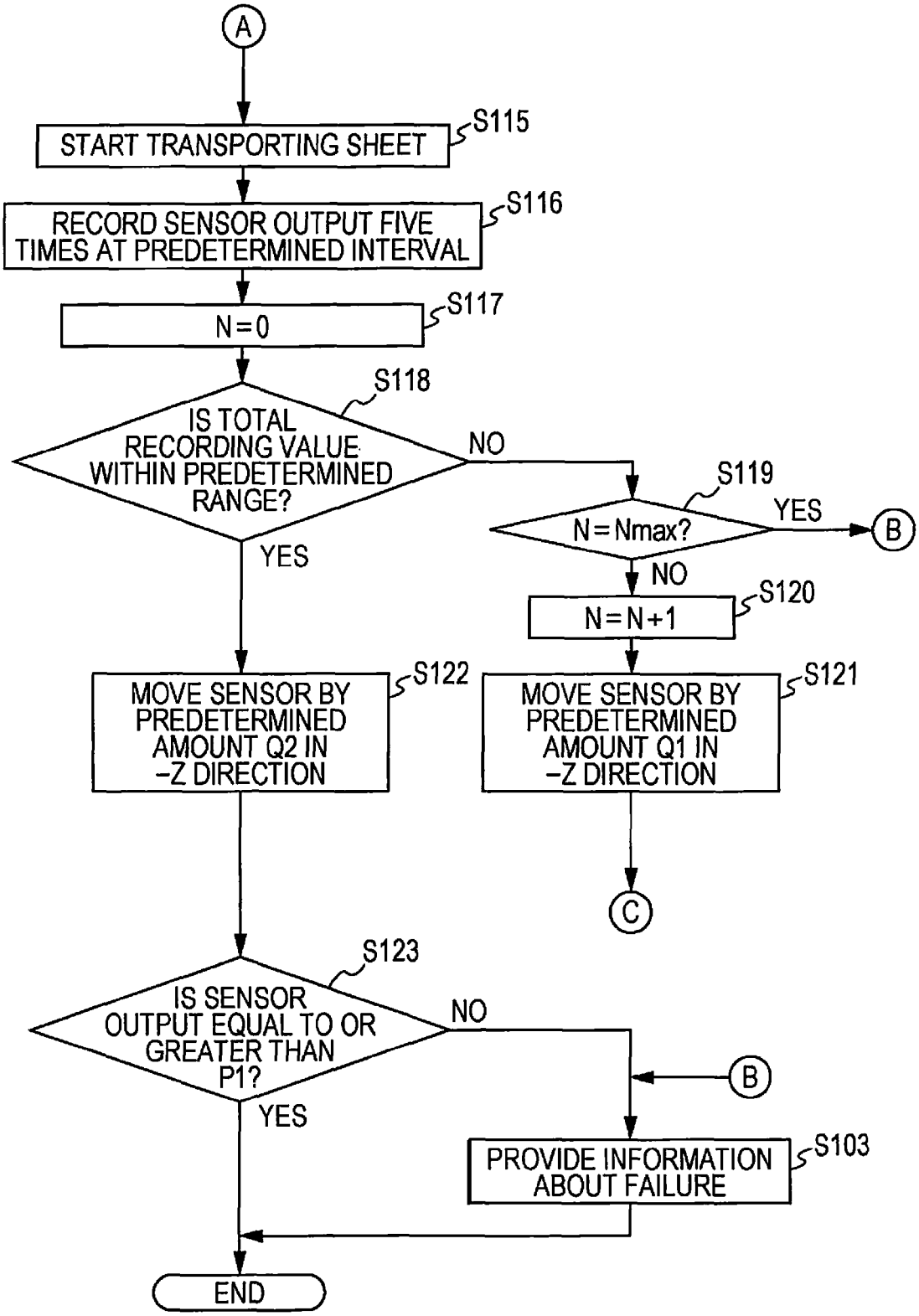
Figure 6:
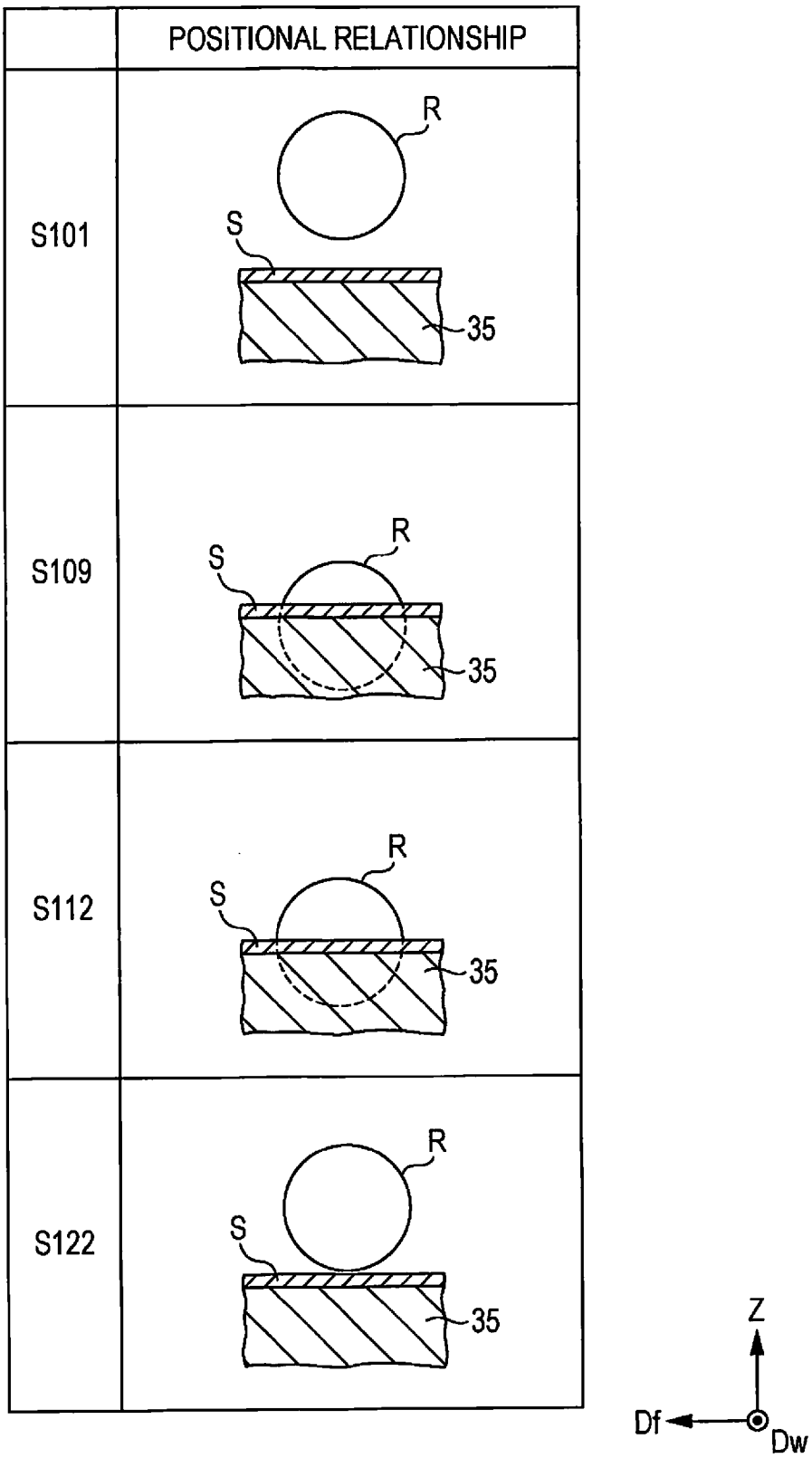
FIG. 6 is a diagram showing variations in a positional relationship between the foreign matter sensor and an object.

FIGS. 5A and 5B are flowcharts showing an example of the calibration executed by the printer control unit on the foreign matter sensor. FIG. 6 is a diagram schematically showing variations in positional relationship between the foreign matter sensor and the object with the execution of the flowcharts in FIGS. 5A and 5B. In FIG. 6, a light receiving region R in which the light receiving unit Lr can receive light from the light emitting unit Le is schematically shown by a circle. In addition, the portion surrounded by the broken line in the light receiving region R of the light receiving unit Lr is a portion hidden by the sheet S and the backup roller 35. In the following description, the side of the arrow in the Z direction will be appropriately referred to as a +Z direction, and a side opposite to the arrow in the Z direction will be appropriately referred to as a −Z direction.

The calibrations shown in FIGS. 5A and 5B are executed when a predetermined unit of printing (a print job, for example) is completed. Here, the printer 1 according to the embodiment can execute the flowcharts in FIGS. 5A and 5B by regarding a series of printing operations executed while the sheet S is successively transported as a print job. In Step S101, the sensor motor M8 moves the foreign matter sensor 71 in the Z direction, and the foreign matter sensor 71 is made to recover to an original point. At this time, the printer control unit 100 causes the foreign matter sensor 71 to recover to the original point by moving the foreign matter sensor 71 until a sensor, which is not shown in the drawing, detects that the foreign matter sensor has reached the original point.

As a result of the recovery to the original point in Step S101, the light receiving region R of the light receiving unit Lr is exposed to the light emitting unit Le without being hidden by the sheet S and the backup roller 35 when viewed in the width direction Dw (the section of "S101" in FIG. 6). Accordingly, the foreign matter sensor 71 basically outputs a signal of the maximum level P0 (=3000). However, the light emitting unit Le or the light receiving unit Lr of the foreign matter sensor 71 is contaminated with ink or the like, there is also a case where the level of the signal output from the foreign matter sensor 71 is degraded. Thus, it is determined in Step S102 whether or not the level of the signal output from the foreign matter sensor 71 is equal to or greater than an allowable level P1 (=2500<P0). Then, it is determined that the level of the signal output from the foreign matter sensor 71 is less than the allowable level P1 ("No" in Step S102), an information of the failure is provided to the user in Step S103, and the flowcharts in FIGS. 5A and 5B are completed. The information of the failure can be provided to the user by displaying on the user interface 200, for example, that the failure has occurred or by using alarm sound such as a buzzer or alarm light such as a lamp.

If the level of the signal output from the foreign matter sensor 71 is equal to or greater than the allowable level P1 ("Yes" in Step S102), it is confirmed that the tension Ta, Tb, and Tc are applied to the sheet S based on the detection values of the tension sensors S21, S34, and S41 (Step S104). At this time, if it is confirmed that the tension Ta, Tb, and Tc are not applied to the sheet S, the printer control unit 100 executes the application of the tension Ta, Tb, and Tc to the sheet S.

Subsequently, moving of the foreign matter sensor 71 in the −Z direction is started, and the foreign matter sensor 71 moves toward the sheet S in Step S105. The movement of the foreign matter sensor 71 is executed at an acceleration rate of 50 mm/s$^2$. Then, Step S106 for checking whether or not the moving amount of the foreign matter sensor 71 is equal to or greater than a predetermined amount (=6 mm) and Step S107 for checking whether or not the level of the signal output from the foreign matter sensor 71 reaches a position adjustment start level P2 (=1200<P1) are repeatedly executed.

If the moving amount of the foreign matter sensor 71 becomes equal to or greater than the predetermined value without the level of the signal from the foreign matter sensor 71 reaching the position adjustment start level P2 ("Yes" in Step S106), the moving of the foreign matter sensor 71 is stopped in Step S108, the processing proceeds to Step S103 to provide information about the failure, and the flowcharts in FIGS. 5A and 5B are completed. In contrast, if the level of the signal from the foreign matter sensor 71 reaches the position adjustment start level P2 before the moving amount of the foreign matter sensor 71 becomes equal to or greater than the predetermined value ("Yes" in Step S107), the processing proceeds to Step S109 to stop the moving of the foreign matter sensor 71. As a result, a major part of the light receiving region R of the light receiving unit Lr is hidden by the sheet S and the backup roller 35 when viewed in the width direction Dw, and a part which is less than a half of the receiving region R of the light receiving unit Lr is exposed to the light emitting unit Le as shown in the section of "S109" in FIG. 6.

Next, the position adjustment processing (Steps S110 to S114) for adjusting the positional relationship between the foreign matter sensor 71 and the sheet S is executed while the foreign matter sensor 71 is intermittently moved. That is, a count value M obtained by counting the number of times of the intermittent motion is reset to zero in Step S110. Subsequently, the foreign matter sensor 71 is moved in the +Z direction by a minute amount q (=0.005 mm) (Step S111), and it is determined whether or not the level of the signal output from the foreign matter sensor 71 is within a predetermined range, that is, within an error range Δa (=±30) from a target value P3 (=1700>P2) (Step S112). The intermittent motion is executed at an acceleration rate of 10 mm/s$^2$ at this time.

If the level of the signal output from the foreign matter sensor 71 is not within the predetermined error range Δa from the target value P3 ("No" in Step S112), it is determined whether or not the count value M is equal to the maximum count value Mmax (Step S113). If the count value M is less than the maximum count value Mmax (=100) ("No" in Step S113), the count value M is incremented in Step S114, and Steps S111 and S112 are executed again. By executing the position adjustment processing in Steps S110 to S114 as described above, the positional relationship between the foreign matter sensor 71 and the sheet S is adjusted such that the level of the signal output from the foreign matter sensor 71 is within the predetermined error range Δa from the target value P3. As a result, about a half of the light receiving region R of the light receiving unit Lr is exposed to the light emitting unit Le when viewed in the width direction Dw (the section of "S112" in FIG. 6). If the adjustment of the positional relationship between the foreign matter sensor 71 and the sheet S is not completed even if the count value M reaches the maximum count value Mmax ("Yes" in Step S113), Step S105 and the following steps are executed again.

If the adjustment of the positional relationship between the foreign matter sensor 71 and the sheet S is completed ("Yes" in Step S112), the transport of the sheet S in the transport direction Df is started (Step S115), and an operation of recording the level of the signal output from the foreign matter sensor 71 is executed five times every time the sheet S is moved at a predetermined interval (=100 mm) (Step S116). Then, the count value N obtained by counting the number of times the position adjustment processing (Steps S110 to S114) is executed is reset to zero (Step S117), and it is determined whether or not all the five recorded values are within a predetermined range, that is, within a predetermined error range Δb (=±50>Δa) from the target value P3 (Step S118).

If one or more of the five recording value are not within the error range Δb from the target value P3 ("No" in Step S118), it is determined whether or not the count value N is equal to the maximum count value Nmax (Step S119). If the count value N is less than the maximum count value Nmax (=3) ("No" in Step S119), the count value N is incremented in Step S120, the foreign matter sensor 71 is moved in the −Z direction by a predetermined amount Q1 (=1 mm) in Step S121, and the position adjustment processing (Steps S110 to S114) is executed again. In contrast, if the count value N is equal to the maximum count value Nmax ("Yes" in Step S119), the information of the failure is provided to the user in Step S103, and the flowcharts in FIGS. 5A and 5B are completed.

If all the five recorded values are within the error range Δb from the target value P3 ("Yes" in Step S118), the foreign matter sensor 71 is moved in the −Z direction by the predetermined amount Q2 (=the thickness of the sheet S+0.38 mm) in Step S122. In so doing, the light receiving region R of the light receiving unit Lr deviates on the front surface side (the side of the recording heads 51 and 52) from the sheet S when viewed in the width direction Dw as shown in the section of "S122" in FIG. 6, and the foreign matter on the surface of the sheet S can be reliably detected. Then, it is determined whether or not the level of the signal output from the foreign matter sensor 71 is equal to or greater than the allowable level P1 in Step S123. Then, if the level of the signal output from the foreign matter sensor 71 is equal to or greater than the allowable level P1 ("Yes" in Step S123), the flowcharts in FIGS. 5A and 5B are immediately completed, and preparation for next image recording executed on the sheet S is made. In contrast, if the level of the signal output from the foreign matter sensor 71 is less than the allowable level P1 ("No" in Step S123), the information of the failure is provided to the user in Step S103, and the flowcharts in FIGS. 5A and 5B are completed.

According to the embodiment configured as described above, the positional relationship between the foreign matter sensor 71 and the sheet S is adjusted based on the detection value (the level of the output signal) of the foreign matter sensor 71 while changing the positional relationship between the foreign matter sensor 71 and the sheet S in the position adjustment processing (Steps S110 to S114) as described above. Then, the positional relationship between the foreign matter sensor 71 and the sheet S is set based on the adjustment result (Step S122). As a result, it is possible to appropriately set the positional relationship between the foreign matter sensor 71 and the sheet S and to suppress deterioration of the detection accuracy of the foreign matter sensor 71.

Incidentally, the position adjustment processing is not always successfully performed in the calibration. In a case in which a foreign matter is present at a position where the foreign matter sensor 71 performs detection in the position adjustment processing, for example, the position of the foreign matter sensor 71 is adjusted relative to the foreign matter on the sheet S. In such a case, the appropriate positional relationship between the foreign matter sensor 71 and the sheet S is not obtained (that is, the position adjustment processing fails).

Thus, in the calibration according to the present embodiment, the foreign matter sensor 71 is made to detect positions of the sheet S, which are different in the transport direction Df from the position of the sheet S detected by the foreign matter sensor 71 in the position adjustment processing, after the completion of the position adjustment processing (Steps S115 and S116). Then, it is determined whether or not all the detection values (recorded values) are within the predetermined error range Δb from the target value P3, and based on the determination result, it is determined whether or not the position adjustment processing has successfully been made (Step S118).

That is, if a foreign matter is present at a position where the foreign matter sensor 71 is detected in the position adjustment processing and the position adjustment processing fails, the foreign matter sensor 71 deviates from an appropriate position relative to the sheet S. A result (a recorded value in Step S116) of detecting, by the foreign matter sensor 71, the position (second position) that is different from the detection position (first position) in the position adjustment processing, that is, the position at which no foreign matter is expected to be present, the foreign matter sensor 71 is considered to deviate from the predetermined error range Δb from the target value P3. Thus, according to the embodiment, it is determined whether or not the position adjustment processing has successfully been performed based on whether or not all the five recorded values in Step S116 are within the predetermined error range Δb from the target value P3.

If it is determined that the position adjustment processing has failed in the calibration, the position adjustment processing is executed again (Step S118). Therefore, it is possible to appropriately set the positional relationship between the foreign matter sensor 71 and the sheet S and to suppress deterioration of the detection accuracy of the foreign matter sensor 71 by executing the position adjustment processing again even if the position adjustment processing fails.

Incidentally, the foreign matter sensor 71 is for detecting a foreign matter on the sheet S on the front surface side of the sheet S. Thus, the foreign matter sensor 71 is made to deviate to the front surface side of the sheet S as compared with the positional relationship, which is adjusted in the position adjustment processing, after the execution of the position adjustment processing in the calibration (Step S122). With such a configuration, it is possible to set the positional relationship between the foreign matter sensor 71 and the sheet S suitable for the detection of a foreign matter and to highly accurately detect the foreign matter.

According to the embodiment, the printer 1 corresponds to an example of the "image recording apparatus" of the invention, the delivery shaft 20, the front drive roller 31, the back drive roller 32, and the winding shaft 40 cooperate and function as an example of the "transport unit" of the invention, the foreign matter sensor 71 corresponds to an example of the "sensor" or the "foreign matter sensor" of the invention, the light emitting unit Le corresponds to an example of the "light emitting unit" of the invention, the light receiving unit Lr corresponds to an example of the "light receiving unit" of the invention, the drive unit 8 corresponds to an example of the "drive unit" of the invention, the printer control unit 100 corresponds to an example of the "control unit" of the invention, the sheet S corresponds to an example of the "object" of the invention, the transport direction Df corresponds to an example of the "transport direction" of the invention, and the Z direction corresponds to an example of the "direction intersecting the transport direction".

The invention is not limited to the above embodiment, and various modifications cam be added to the aforementioned configurations without departing from the gist thereof. According to the embodiment, the calibration is executed after a predetermined unit of printing is completed, for example. However, the execution timing of the calibration is not limited thereto.

Thus, another configuration is also applicable in which the calibration is executed when the sheet S installed in the printer 1 is replaced. Specifically, the calibration may be executed when the user inputs information indicating that the sheet S has been replaced, via the user interface 200. With such a configuration, it is possible to appropriately set the positional relationship between the foreign matter sensor 71 and the sheet S and to suppress deterioration of the detection accuracy of the foreign matter sensor 71 even if the positional relationship between the foreign matter sensor 71 and the sheet S varies with the replacement of the sheet S.

Alternatively, another configuration is also applicable in which the calibration is executed when the type of the sheet S is changed. Specifically, the calibration may be executed when the type of the sheet S, which is input by the user via the user interface 200, is changed before and after the input.

At this time, the printer control unit 100 may change the target value P3 in Step S112 in the calibration in accordance with the type of the sheet S. That is, the position of the foreign matter sensor 71 is adjusted such that about a half of the light receiving region R of the light receiving unit Lr is exposed to the light emitting unit Le by roughly adjusting the level of the signal from the foreign matter sensor 71 to the target value P3 in Step S112. However, the amount of light which reaches the light receiving unit Lr of the foreign matter sensor 71 also depends on the type of the sheet S. Therefore, the amount of light which reaches the light receiving unit Lr in the where about a half of the light receiving region R of the light receiving unit Lr is exposed to the light emitting unit Le, in other words, the level of the signal from the sensor 71 also varies depending on the type of the sheet S. For this reason, the positional relationship between the foreign matter sensor 71 and the sheet S after the adjustment in the position adjustment processing varies depending on the sheet S unless the target value P3 in Step S112 is not changed in accordance with the type of the sheet S. Thus, it is preferable to change the target value P3 in accordance with the type of the sheet S.

In a specific example, the amount of light received by the light receiving unit Lr tends to increase by about 10% to 20% in the case of a transparent film-type sheet S as compared with a typical white paper-type sheet S, and therefore, it is preferable to set the target value P3 to be higher by about 10% to 20%. Since the amount of light received by the light receiving unit Lr tends to increase by about 10% to 20% in the case of the sheet S with low surface reflectance (rough surface) as compared with a typical white paper-type sheet S, it is preferable to set the target value P3 to be lower by about 10% to 20%. Since the amount of light received by the light receiving unit Lr tends to increase by about 20% to 30% in the case of the sheet S with low surface reflectance (rough surface) as compared with a typical white paper-type sheet S, it is preferable to set the target value P3 to be lower by about 20% to 30%. Since the amount of light received by the light receiving unit Lr tends to decrease by about 10% in the case of the sheet S with a narrow width (80 mm in the width direction Dw) as compared with a sheet S with a wide width (330 mm in the width direction Dw), it is preferable to set the target value P3 to be lower by about 10%.

Moreover, the target positional relationship between the foreign matter sensor 71 and the sheet S in Step S112 is a positional relationship in which about a half of the light receiving region R of the light receiving unit Lr is exposed to the light emitting unit Le. However, the target positional relationship between the foreign matter sensor 71 and the sheet S is not limited to this example, and another positional relationship in which about one third of the light receiving region R of the light receiving unit Lr is exposed to the light emitting unit Le, for example, may also be targeted.

In addition, a specific method of determining whether or not the position adjustment processing has successfully been performed is not limited to the aforementioned embodiment. For example, the appropriate positional relationship between the foreign matter sensor 71 and the sheet S can be expected based on the thickness of the sheet S to some extent. Thus, it is also possible to determine whether or not the position adjustment processing has successfully been performed by comparing the positional relationship between the foreign matter sensor 71 and the sheet S, which is expected based on the thickness of the sheet S, with the positional relationship between the foreign matter sensor 71 and the sheet S after the position adjustment processing. It is also possible to know whether or not the position adjustment processing has successfully been performed even by such a method based on the thickness of the sheet S.

Furthermore, the position adjustment processing may be executed again if it is determined that the position adjustment processing has failed as a result of determining whether or not the position adjustment processing has successfully been performed based on the thickness of the sheet S. With such a configuration, it is possible to appropriately set the positional relationship between the foreign matter sensor 71 and the sheet S and suppress deterioration of the detection accuracy of the foreign matter sensor 71 by executing the position adjustment processing again even if the position adjustment processing fails.

In the aforementioned embodiment, the failure of the position adjustment processing caused by detecting the position at which the foreign matter is present is handled by executing Steps S115 to S118. However, a specific method of handling the failure is not limited thereto. Thus, the position adjustment processing may be executed three or more times in the calibration, and the positional relationship between the foreign matter sensor 71 and the sheet S may be set based on the position adjustment processing other than the position adjustment processing which is considered to have failed.

Specifically, the position adjustment processing is executed at a plurality of positions which are different from each other in the transport direction Df. Then, position adjustment processing in which a value indicating the positional relationship between the foreign matter sensor 71 and the sheet S, for example, a position of the foreign matter sensor 71 indicated by the encoder of the sensor motor M8 corresponds to an outlier is specified in the position adjustment processing performed plurality of times. Then, the positional relationship between the foreign matter sensor 71 and the sheet S is set based on the position of the foreign matter sensor 71 adjusted in the position adjustment processing other than the specified position adjustment processing.

That is, the position of the foreign matter sensor 71 which is adjusted in the position adjustment processing performed on the assumption of detecting a position where a foreign matter is present is different from the position of the foreign matter sensor 71 which is adjusted in the position adjustment processing performed on the assumption of detecting a position where no foreign matter is present. For this reason, the position adjustment processing, in which the position of the foreign matter sensor 71 corresponds to an outline, from among position adjustment processing performed three or more times at different positions can be considered as position adjustment processing performed on the assumption of detecting the position where the foreign matter is present. Thus, it is possible to appropriately set the positional relationship between the foreign matter sensor 71 and the sheet S and to suppress deterioration of the detection accuracy of the foreign matter sensor 71 by setting the positional relationship between the foreign matter sensor 71 and the sheet S based on the position of the foreign matter sensor 71 which is adjusted in the position adjustment processing other than the position adjustment processing performed on the assumption of detecting the position where the foreign matter is present.

In the aforementioned embodiment, the example in which the calibration is executed on the foreign matter sensor 71 was described. However, the printer 1 may be configured such that the calibration is executed on the foreign matter sensor 72 or the foreign matter sensor 73. Particularly, the rotation drum 30 as an object O of the foreign matter sensor 73 thermally expands or thermally contracts with variations in temperature. Therefore, there is a concern in that the detection accuracy of the foreign matter sensor 73 deteriorates due to variations in the positional relationship between the foreign matter sensor 73 and the rotation drum 30 if the temperature of the rotation drum 30 varies. Therefore, by appropriately executing the calibration on the foreign matter sensor 73, it is possible to appropriately set the positional relationship between the foreign matter sensor 73 and the rotation drum 30 and to suppress deterioration of the detection accuracy of the foreign matter sensor 73.

At this time, the calibration may be executed after the completion of a predetermined unit of printing as described above, or when a value relating to the thermal expansion of the rotation drum 30 changes by an amount that is equal to or greater than a predetermined amount. That is, the temperature of the rotation drum 30 increases and the rotation drum 30 tends to thermally expands with the execution of image recording. Thus, the printer control unit 100 (acquisition unit) may count elapsed time after the start of the image recording, and if the elapsed time becomes equal to or greater than predetermined time, the printer control unit 100 may interrupt the image recording and execute the calibration. With such a configuration, it is possible to appropriately set the positional relationship between the foreign matter sensor 71 and the rotation drum 30 and to suppress deterioration of the detection accuracy of the foreign matter sensor 72 even if the rotation drum 30 thermally expands as an increase in temperature. Furthermore, the temperature of the rotation drum 30 decreases and the rotation drum 30 tends to thermally contracts when the rotation drum waits for image recording. Thus, the printer control unit 100 (acquisition unit) may count elapsed time after completion of image recording, and if the elapsed time becomes equal to or greater than predetermined time while the next image recording is not started, the printer control unit 100 may execute the calibration. With such a configuration, it is possible to appropriately set the positional relationship between the foreign matter sensor 71 and the rotation drum 30 and to suppress deterioration of the detection accuracy of the foreign matter sensor 72 even if the rotation drum 30 thermally contracts with the decrease in temperature.

Furthermore, the content and the order of the respective steps in the calibrations shown in FIGS. 5A and 5B can be appropriately changed. For example, the level of the signal output from the foreign matter sensor 71 is recorded five times in Step S116. However, the number of times of the recording is not limited to five and can be appropriately changed.

In addition, the level of the signal output from the foreign matter sensor 71 is made to be within the predetermined error range Δa from the target value P3 by gradually exposing the light receiving region R of the foreign matter sensor 71 from the state in which the light receiving region R of the foreign matter sensor 71 is hidden by the sheet S and the backup roller 35 to some extent in the aforementioned position adjustment processing. However, the position adjustment processing may be configured such that the level of the signal output from the foreign matter sensor 71 is made to be within the predetermined error range Δa from the target value P3 by gradually hiding the light receiving region R of the foreign matter sensor 71 from a state in which the light receiving region R of the foreign matter sensor 71 is exposed from the sheet S and the backup roller 35 to some extent.

In the aforementioned embodiment, the description was given of the case in which the invention was applied to the foreign matter sensors 71, 72, and 73. However, the type of the sensor to which the invention can be applied is not limited to a foreign matter sensor, and the invention can be generally applied to sensors capable of detecting a state of the object O.

In the aforementioned embodiment, an image is recorded by causing the recording heads 51 and 52 to eject the UV ink. However, an image may be recorded by causing the recording heads 51 and 52 to eject water-based ink.

In the aforementioned embodiment, the foreign matter sensor 72 is arranged on the back surface side of the sheet S and detects presence of a foreign matter on the sheet S on the back surface side of the sheet S. However, another configuration is also applicable in which the foreign matter sensor 72 is arranged on the front surface side of the sheet S and detects presence of a foreign matter on the sheet S on the front surface side of the sheet S.

In addition, a member which supports the transported sheet S is not limited to the member with a cylindrical shape such as the aforementioned rotation drum 30. Therefore, it is also possible to employ a flat-type platen which supports the sheet S by a plane.

The entire disclosure of Japanese Patent Application No. 2014-054352, filed Mar. 18, 2014 is expressly incorporated by reference herein.

What is claimed is:

1. An image recording apparatus comprising:

a sensor configured to detect a state of an object and outputs a detection value;

a drive unit configured to be able to move the sensor in a direction in which the sensor approaches the object and in a direction in which the sensor is away from the object; and a control unit configured to execute calibration for setting a positional relationship between the sensor and the object based on the detection value of the sensor while causing the drive unit to change the positional relationship between the sensor and the object, the calibration including position adjustment processing of adjusting the positional relationship between the sensor and the object based on the detection value of the sensor while causing the drive unit to change the positional relationship between the sensor and the object, and processing of determining whether or not the position adjustment processing has successfully been performed.

2. The image recording apparatus according to claim 1, wherein the object is a recording medium on which an image is recorded.

3. The image recording apparatus according to claim 2, wherein the control unit executes the calibration when a type of the recording medium is changed.

4. The image recording apparatus according to claim 2, wherein the control unit executes the calibration when the recording medium is replaced.

5. The image recording apparatus according to claim 2, wherein in the processing of determining whether or not the position adjustment processing has successfully been made, the control unit determines whether or not the position adjustment processing has successfully been performed based on comparison of a positional relationship between the sensor and the object, which is expected based on a thickness of the recording medium, with a positional relationship between the sensor and the object after the position adjustment processing.

6. The image recording apparatus according to claim 1, wherein in the processing of determining whether or not the position adjustment processing has successfully been made, the control unit executes the position adjustment processing again if it is determined that the position adjustment processing has failed.

7. The image recording apparatus according to claim 1, further comprising:

a support member configured to support a recording medium, on which an image is recorded, and thermally expand with an increase in temperature, wherein the object is the support member.

8. The image recording apparatus according to claim 7, further comprising:

an acquisition unit configured to acquire a value relating to the thermal expansion of the support member, wherein the control unit executes the calibration based on the value obtained by the acquisition unit.

9. The image recording apparatus according to claim 1, wherein in the processing of determining whether or not the position adjustment processing has successfully been made, the control unit determines whether or not the position adjustment processing has successfully been made based on a result obtained by causing the sensor to detect a first position as a position of the object which is detected by the sensor in the position adjustment processing and a second position as a position of the object which is different from the first position in a transport direction of the object.

10. The image recording apparatus according to claim 9, wherein in the processing of determining whether or not the position adjustment processing has successfully been made, the control unit executes the position adjustment processing again if it is determined that the position adjustment processing has failed.

11. The image recording apparatus according to claim 1, wherein in the processing of determining whether or not the position adjustment processing has successfully been made, the control unit executes the position adjustment processing at each of three or more positions of the object, which are different from each other in the transport direction, and sets the positional relationship between the sensor and the object based on a result of the position adjustment processing other than position adjustment processing, in which a value representing the positional relationship between the sensor and the object is an outlier, from among the position adjustment processing performed a plurality of times.

12. The image recording apparatus according to claim 1, wherein in the position adjustment processing, the positional relationship between the sensor and the object is adjusted such that the detection value of the sensor is within a predetermined range.

13. The image recording apparatus according to claim 1, wherein the sensor is a foreign matter sensor configured to detect a foreign matter on the object on one side of the object, and wherein the control unit sets the positional relationship between the sensor and the object such that the sensor is made to deviate on the one side with respect to the object as compared with the positional relationship adjusted in the position adjustment processing, after execution of the position adjustment processing.

14. The image recording apparatus according to claim 1, wherein the sensor includes a light emitting unit provided so as to correspond to one end of the object and a light receiving unit provide so as to correspond to the other end of the object, and the sensor outputs a detection value in accordance with an amount of light emitted by the light emitting unit and received by the light receiving unit.

15. A calibration method comprising:

setting a positional relationship between an object and a sensor capable of detecting a state of the object in an image recording apparatus based on a detection value of the sensor while changing the positional relationship between the sensor and the object by moving the sensor, the setting including position adjustment processing of adjusting the positional relationship between the sensor and the object based on the detection value of the sensor while changing the positional relationship between the sensor and the object, and processing of determining whether or not the position adjustment processing has successfully been performed.

16. An image recording method comprising:

a first process in which a positional relationship between an object and a sensor capable of detecting a state of the object is set in an image recording apparatus based on a detection value of the sensor while changing the positional relationship between the sensor and the object by moving the sensor; and a second process in which an image recording is executed, the first process including position adjustment processing of adjusting the positional relationship between the sensor and the object based on the detection value of the sensor while changing the positional relationship between the sensor and the object, and processing of determining whether or not the position adjustment processing has successfully been performed.

* * * * *